US008424259B2

(12) United States Patent
Koren

(10) Patent No.: US 8,424,259 B2
(45) Date of Patent: Apr. 23, 2013

(54) SYSTEM AND METHOD FOR INSTALLING COLUMNS

(75) Inventor: Robert Douglas Koren, Cary, NC (US)

(73) Assignee: Column & Post, Inc., Fuquay-Varina, NC (US)

( * ) Notice: Subject to any disclaimer, the term of this patent is extended or adjusted under 35 U.S.C. 154(b) by 0 days.

(21) Appl. No.: 13/197,466

(22) Filed: Aug. 3, 2011

(65) Prior Publication Data

US 2013/0031860 A1 Feb. 7, 2013

(51) Int. Cl.
*E04C 3/30* (2006.01)

(52) U.S. Cl.
USPC ..... 52/301; 52/309.4; 52/835

(58) Field of Classification Search ..... 52/300, 52/301, 309.1, 309.4, 834, 835, 745.17; 248/345, 248/357; 403/288; 256/65.14
See application file for complete search history.

(56) References Cited

U.S. PATENT DOCUMENTS

| | | | | | |
|---|---|---|---|---|---|
| 973,615 | A | | 10/1910 | Barrick | |
| 1,086,679 | A | | 2/1914 | McCarty | |
| 1,350,686 | A | * | 8/1920 | Trudelle | 52/834 |
| 1,851,404 | A | * | 3/1932 | Rose | 5/281 |
| 1,874,057 | A | | 8/1932 | Murphy | |
| 1,934,260 | A | | 11/1933 | Dean | |
| 2,240,016 | A | | 4/1941 | Pinney | |
| 2,664,977 | A | * | 1/1954 | Starcevich | 52/301 |
| 3,421,269 | A | * | 1/1969 | Medow | 52/86 |
| 3,998,025 | A | | 12/1976 | Nestroy | |
| 4,304,408 | A | * | 12/1981 | Greenawalt | 277/373 |
| 4,509,881 | A | | 4/1985 | Welch | |
| 4,587,788 | A | | 5/1986 | Bielicki | |
| 4,641,467 | A | | 2/1987 | Dupuis, Jr. | |
| 4,912,901 | A | * | 4/1990 | Jerry | 52/301 |
| 5,156,483 | A | * | 10/1992 | Mangas | 403/288 |
| 5,335,471 | A | | 8/1994 | Kupiec | |
| 5,419,538 | A | | 5/1995 | Nicholas et al. | |
| 5,421,556 | A | * | 6/1995 | Dodge et al. | 256/1 |
| 5,605,023 | A | | 2/1997 | Biernazki | |
| 5,853,167 | A | * | 12/1998 | West et al. | 256/66 |
| 5,920,959 | A | * | 7/1999 | DeMarco | 16/257 |
| 5,934,035 | A | | 8/1999 | Rasmussen et al. | |
| 5,946,880 | A | | 9/1999 | Morrison, III et al. | |
| 6,305,670 | B1 | | 10/2001 | Ward et al. | |
| 6,532,713 | B2 | | 3/2003 | Katayama et al. | |
| 6,789,368 | B2 | | 9/2004 | Savenok | |

(Continued)

OTHER PUBLICATIONS

Turncraft. TimeSaver Cap & Base, 1 sheet, http://www.turncraft.com/pdf/turncraft%20time%20saver.pdf.

*Primary Examiner* — Brian Glessner
*Assistant Examiner* — Brent W Herring
(74) *Attorney, Agent, or Firm* — Coats & Bennett, P.L.L.C.

(57) ABSTRACT

A column assembly includes a shaft, a capital, an opening formed in the capital, and a retaining member. The capital has a lower surface and a substantially planar upper surface. The opening is sized to receive the shaft therethrough, and extends from the lower surface to the upper surface. A channel is formed in a surrounding wall of the opening. The length of the channel may, for instance, extend at least partially around the perimeter of the opening. Regardless, the retaining member advantageously holds the capital at a fixed vertical position along the shaft by engaging the channel and the shaft. The retaining member may be a resilient member (e.g., foam) that seats within the channel and frictionally engages the outer surface of the shaft. Alternatively, the retaining member may be a spring member that mounts onto the upper end of the shaft and engages the channel.

4 Claims, 13 Drawing Sheets

U.S. PATENT DOCUMENTS

| | | | | |
|---|---|---|---|---|
| 7,021,016 | B2 * | 4/2006 | Steffes et al. | 52/311.1 |
| 7,055,256 | B2 | 6/2006 | Alecci | |
| 7,143,556 | B2 * | 12/2006 | Hales | 52/301 |
| 7,188,457 | B1 | 3/2007 | Halama | |
| 7,216,467 | B2 | 5/2007 | Pott | |
| 7,992,362 | B2 * | 8/2011 | Petta | 52/848 |
| 2003/0122115 | A1 * | 7/2003 | Ernst et al. | 256/1 |
| 2006/0112656 | A1 * | 6/2006 | Tarleton et al. | 52/301 |
| 2008/0271396 | A1 * | 11/2008 | Burke | 52/301 |
| 2010/0205884 | A1 * | 8/2010 | Noirot | 52/301 |
| 2011/0008101 | A1 * | 1/2011 | Santi et al. | 403/288 |
| 2012/0031028 | A1 * | 2/2012 | Koren | 52/301 |
| 2012/0189378 | A1 * | 7/2012 | Visa | 403/267 |

* cited by examiner

SYSTEM AND METHOD FOR INSTALLING COLUMNS

BACKGROUND

The present invention relates generally to molded columns, and more particularly to systems and methods for installing molded columns.

Recently, molded columns have been used in place of wooden columns in residential construction. Molded columns have a number of advantages over their wooden counterparts. For example, molded columns generally cost less and are available in a wide variety of sizes and shapes. Further, molded columns are aesthetically pleasing and able to bear heavy loads.

Installation of a molded column can be a difficult and time consuming procedure requiring the combined manpower of multiple workers. The additional labor and time required to properly install a molded column only adds to the cost of the column. However, this cost can be reduced.

SUMMARY

The present invention provides a column assembly to support a load, such as a roof. The column assembly includes a shaft to support the load, as well as a capital and a so-called retaining member. The capital and retaining member are configured to advantageously hold the capital at a fixed vertical position along the shaft. This position may be, for instance, a temporary position that aids a worker during the column installation process and/or the final position upon completion of the installation.

More particularly, the capital has an upper surface and a lower surface. The upper surface comprises a substantially flat, planar surface. Because the surface is substantially planar, the surface advantageously blocks unwanted debris or natural elements from encroaching into the capital and also provides sufficient surface area for placing caulking between the capital and the overhead support surface.

The column assembly further includes an opening formed in the capital. The opening is sized to receive the shaft and extends through the upper and lower surfaces. The opening is defined by a surrounding wall. This wall extends on the interior of the capital between the upper and lower surfaces. Notably, a channel or groove is formed in the surrounding wall of the opening. The retaining member herein is configured to hold the capital at a fixed vertical position along the shaft by engaging this channel and the shaft.

In one embodiment, for example, the retaining member is a resilient member such as foam. This resilient member seats within the channel. Then, when the shaft is received through the capital's opening, the resilient member compresses to fit snugly against the shaft. In this regard, the resilient member frictionally engages the outer surface of the shaft.

In another embodiment, the retaining member is a spring member that mounts on the upper end of the shaft. Mounted in this position, the spring member engages the channel when the capital is moved onto the spring member.

Regardless of the particular type of retaining member, the retaining member conveniently holds the capital in a fixed vertical position along the shaft without the need of cumbersome fasteners (e.g., screws or nails) that may require the combined manpower of multiple workers for proper installation. Moreover, the retaining member proves sufficient for holding a capital that advantageously has a substantially planar upper surface, especially if the capital is made of a lightweight material such as polyurethane foam.

The column assembly may further include a base assembly and an alignment mechanism that assists a worker in vertically aligning the shaft. Specifically, the base assembly comprises a retaining ring having a central opening to receive the bottom part of the shaft. A plurality of notches are formed into a surface of the ring adjacent the opening. The notches form the defining ends of a "cross-hair" having its intersection at the center of the opening. The "cross-hair" functions as a visual aid, in conjunction with a plumb line bob as an alignment mechanism, to help installation workers to vertically align the column.

BRIEF DESCRIPTION OF THE DRAWINGS

FIG. 2A is a side sectional view of the capital taken across line I in FIG. 2B, while FIG. 2B is a perspective view of the capital.

FIG. 3A is a perspective view of the retaining member, while FIG. 3B is a side sectional view of the retaining member taken across line II in FIG. 3A. FIG. 3C is a side sectional view showing use of the retaining member to hold a capital at a fixed vertical position along a shaft.

FIG. 4A is a side view of the retaining member, while FIG. 4B is a perspective view of the retaining member. FIG. 4C is a side sectional view showing use of the retaining member to hold a capital at a fixed vertical position along a shaft.

FIG. 5A is a side sectional view of a plinth of the base assembly, while FIG. 5B is a perspective view of a retaining ring of the base assembly.

DETAILED DESCRIPTION

Figure 1A:
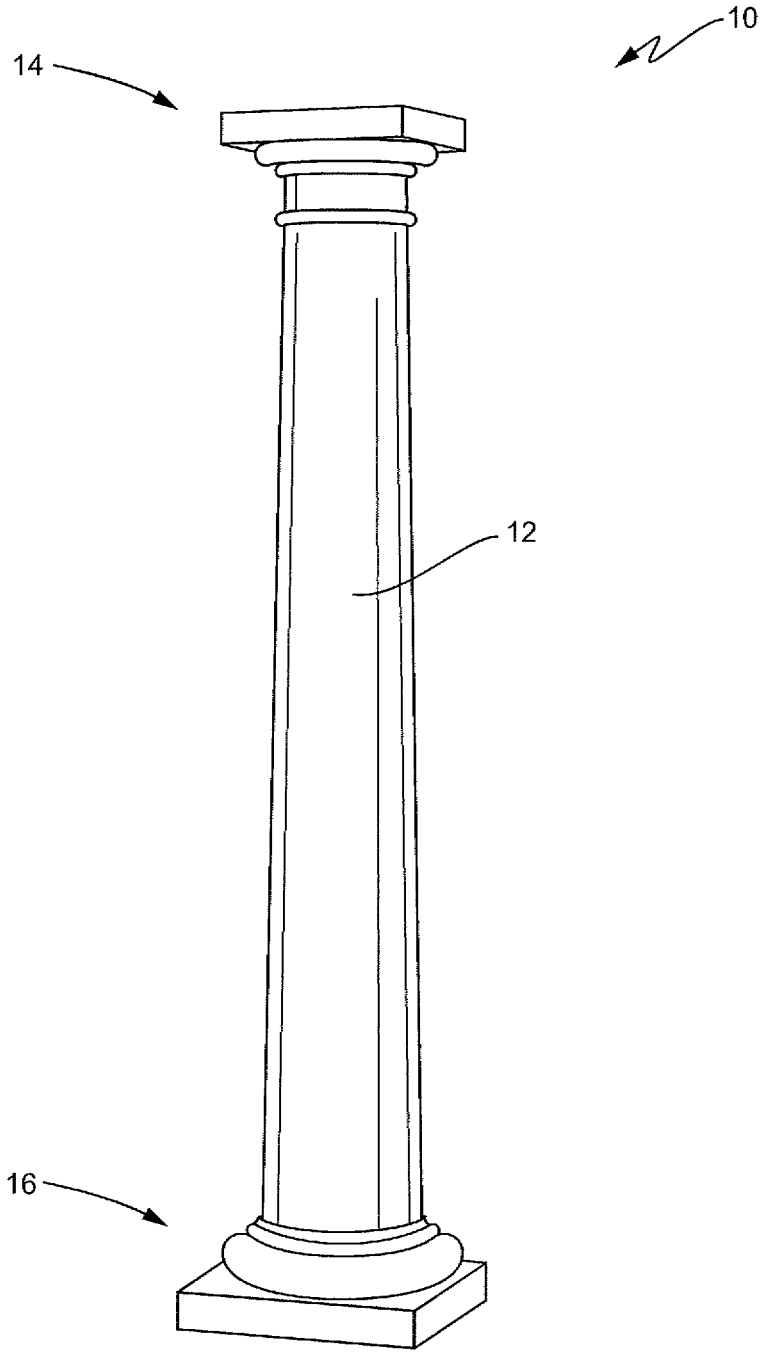
FIG. 1A is a perspective view illustrating some of the components of a shaft configured according to one embodiment of the present invention.
Figure 1B:
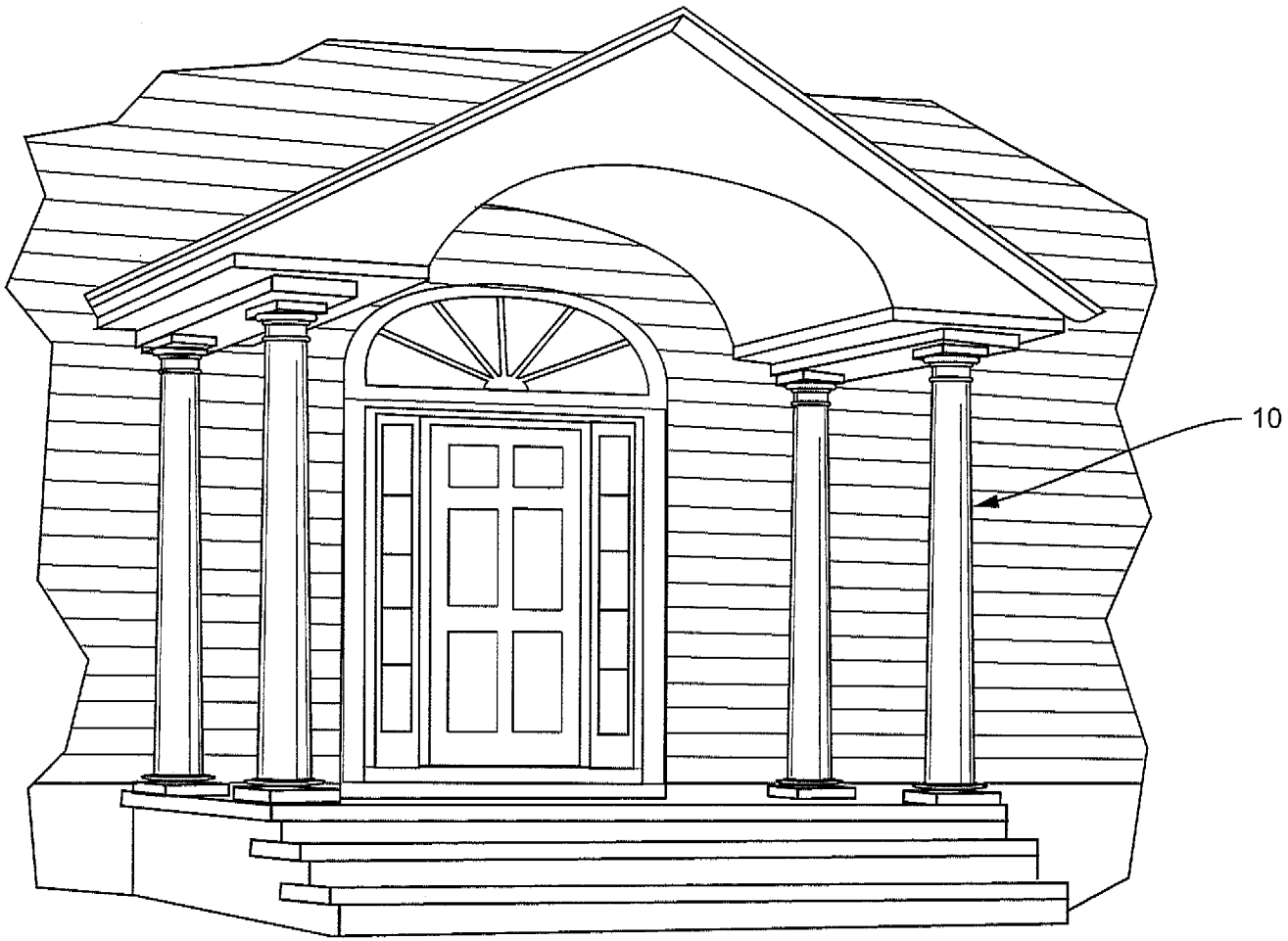
FIG. 1B is a perspective view of a residential column installed according to one embodiment of the present invention.

FIGS. 1A-1B illustrates a column assembly 10 configured according to one embodiment of the present invention. As seen in FIG. 1A, the column assembly 10 includes a shaft 12, a capital 14, and a base assembly 16. The shaft 12 in this embodiment comprises a unitary, elongated, cylindrical molded column and is used to support a load, such as that of a porch roof or other overhead structure (see FIG. 1B). Shaft 12 may be produced using any material and/or manufacturing process known in the art. However, in at least one embodiment, shaft 12 is molded from a mixture of calcium carbonate and a hardening agent (e.g., polyester resin), and is manufactured using a centrifugal molding technique. Regardless, the capital 14 and base assembly 16 include decorative elements that are disposed at the upper and lower parts of the shaft 12, respectively.

Figure 2A:
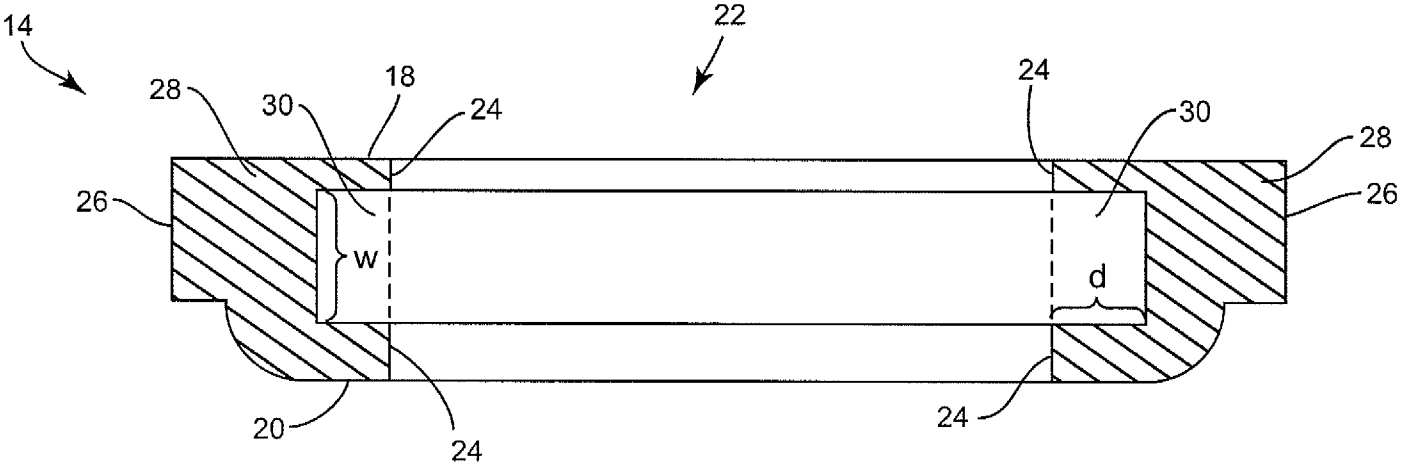
FIGS. 2A-2B illustrate a capital configured according to one embodiment of the present invention. Particularly.
Figure 2B:
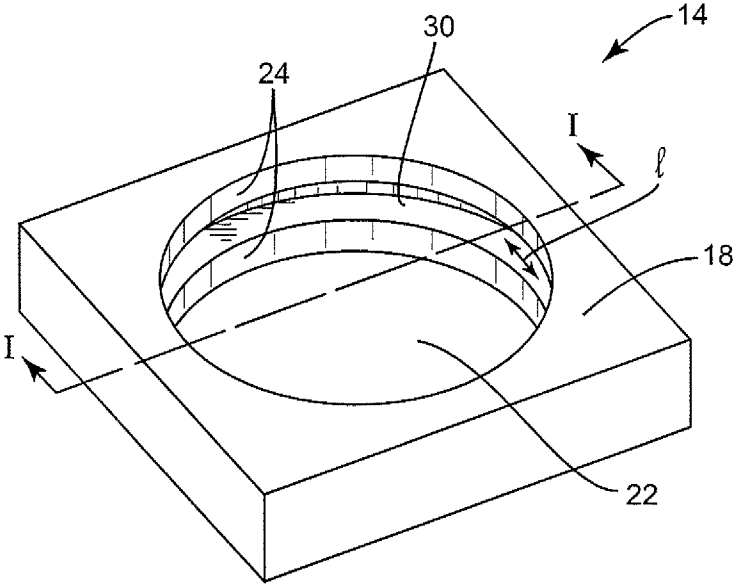

FIGS. 2A-2B illustrate the capital 14, in detail, according to one embodiment. The capital 14 has an upper surface 18 and a lower surface 20. The upper surface 18 comprises a substantially flat, planar surface that, as seen in more detail later, will contact an overhead support surface. Because the surface 18 is substantially planar, the surface 18 advantageously blocks unwanted debris or natural elements from encroaching into the capital 14 and also provides sufficient surface area for placing caulking between the capital 14 and the overhead support surface.

Like the shaft 12, the capital 14 may be produced using any material and/or manufacturing process known in the art; however, in at least one embodiment, the capital 14 is advantageously made of a lightweight material such as polyurethane foam. Made of such a material, the capital 14 is lighter in weight than if made of the same material as the shaft 12, especially since the planar upper surface 18 requires additional material as compared to conventional capitals without a planar upper surface.

Regardless, an opening 22 is formed in the capital 14 and extends through the upper surface 18 as well as the lower surface 20. The opening 22 is sized and shaped to receive the shaft 12 therethrough. As shown, the opening 22 is formed as a round hole in the center of the capital 14. Of course, the size and shape of the opening 22 may be any size and shape desired; however, the opening 22 will have a size and shape that substantially complements that of the shaft 12.

The opening 22 is more particularly defined by a surrounding wall 24. This wall 24 extends on the interior of the capital 14 between the upper and lower surfaces 18, 20, and may thus also be referred to as the interior wall 24. In general, the interior wall 24 has a shape and form separate and distinct from that of the wall 26 extending on the exterior of the capital 14 between the surfaces 18, 20 (i.e., the exterior wall 26). In other words, the interior wall 24 does not simply derive its form from the exterior wall 26 as an interior surface of and complement to the exterior wall 26. Rather, the interior wall 24 is generally formed to complement the outer surface of the shaft 12 (which as shown is a cylinder), while the exterior wall 26 is separately formed with a desired decorative shape. The interior wall 24, exterior wall 26, upper surface 18, and lower surface 20 thus surround and define the body 28 of the capital 14.

Notably, a channel 30 or groove is formed in the surrounding wall 24 of the opening 22. The channel 30 penetrates into the capital's body 28, from the interior wall 24 toward the exterior wall 26, to an extent defined by the channel's depth d. The channel 30 creates a gap in the channel's body 28, between the upper surface 18 and the lower surface 20, that has a size defined by the channel's width w. And the channel 30 stretches horizontally around the perimeter of the opening 22, generally in parallel to the upper and lower surfaces 18, 20, to an extent defined by the channel's length l. As shown, the channel's length l extends around the entire perimeter of the opening 22. However, the channel's length l in some embodiments may just extend partially around the opening's perimeter. Regardless, the channel 30 is dimensioned in terms of its depth d, width w, and length l for engagement with a retaining member described below.

A retaining member herein is configured to hold the capital 14 at a fixed vertical position along the shaft 12 by engaging the channel 30 and the shaft 12. The capital 14 may be installed into such a position by first engaging the retaining member with the channel 30 and then engaging the retaining member with the shaft 12. Alternatively, the capital 14 may installed by first engaging the retaining member with the shaft 12 and then engaging the retaining member with the channel 30.

Figure 3C:
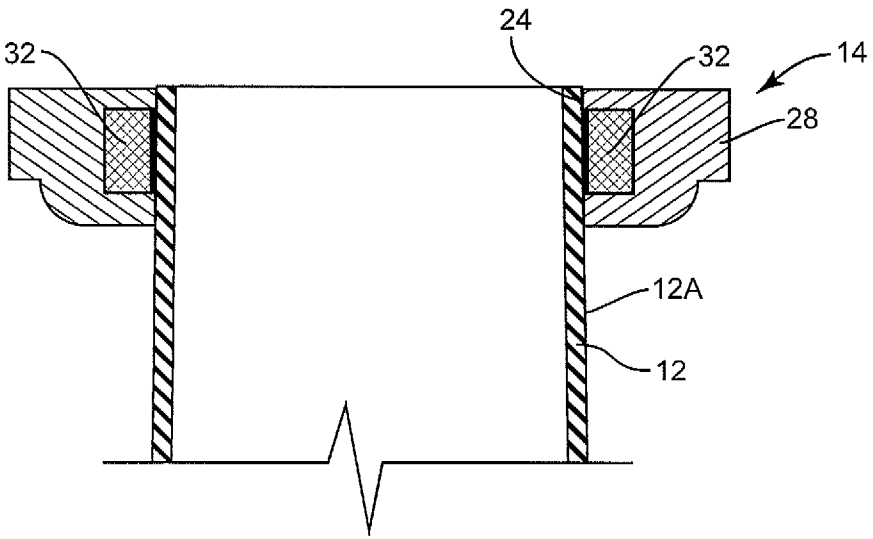
FIGS. 3A-3C illustrate a retaining member according to one embodiment of the present invention. Particularly.
Figure 3A:
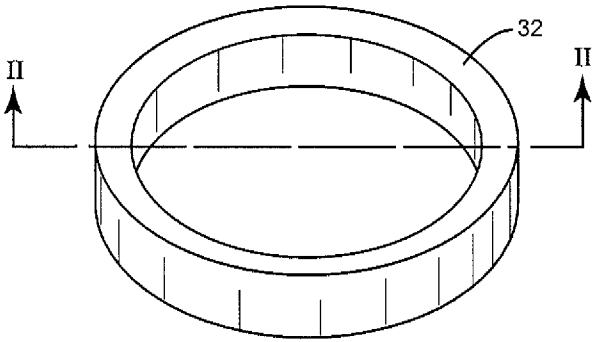
Figure 3B:
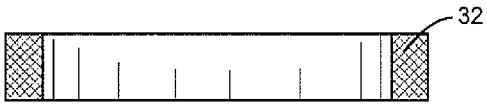

FIGS. 3A-3C illustrate the retaining member as a resilient member 32. The resilient member 32 may be made of any resilient material. However, in at least one embodiment, the resilient member 32 is made of foam, such as closed cell polyethylene foam.

Regardless of the particular composition of the resilient member 32, the member 32 is configured to seat or fit within the channel 30. That is, the resilient member 32 is dimensioned with at least a width and length which approximately complement that of the channel 30. For example, in the case that the channel 30 extends around the entire circumference of a round opening 22, the resilient member 32 comprises a round ring with a matching circumference.

The depth of the resilient member 32 may also complement the channel's depth d. Preferably, though, the resilient member's depth is slightly greater than the channel's depth d. This way, the resilient member 32 protrudes slightly past the surface of the interior wall 24 and into the opening 22 when seated within the channel 30. Then, when the shaft 12 is received through the opening, the resilient member 32 compresses to fit snugly against the shaft 12.

Regardless, the resilient member 32 is configured to frictionally engage the outer surface 12A of the shaft 12 as shown in FIG. 3C. This frictional engagement supports or holds the capital 14 at a fixed vertical position along the shaft 12 (e.g., at the upper end of the shaft 12). In at least one embodiment, though, the capital 14 may be re-positioned to different vertical positions along the shaft 12 as desired. That is, the resilient member 32 engages the outer surface 12A of the shaft 12 with a frictional resistance that is sufficient to hold the capital 14 at any given vertical position along the shaft 12, but that can be overcome to re-position the capital 14 along the shaft 12 as desired. As explained in more detail below, the ability to re-position the capital 14 in this way proves particularly advantageous in the installation process.

Figure 4C:
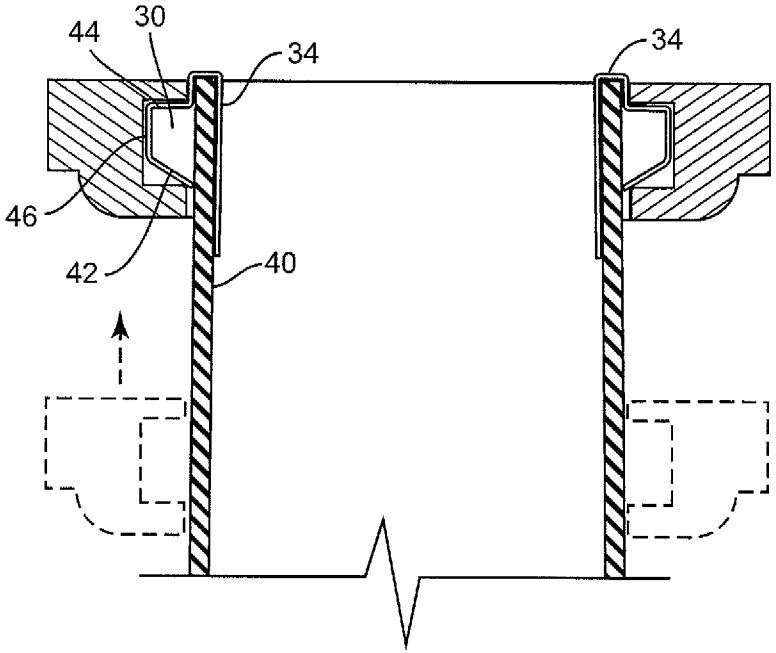
FIGS. 4A-4C illustrate a retaining member according to another embodiment of the present invention. Particularly.
Figure 4B:
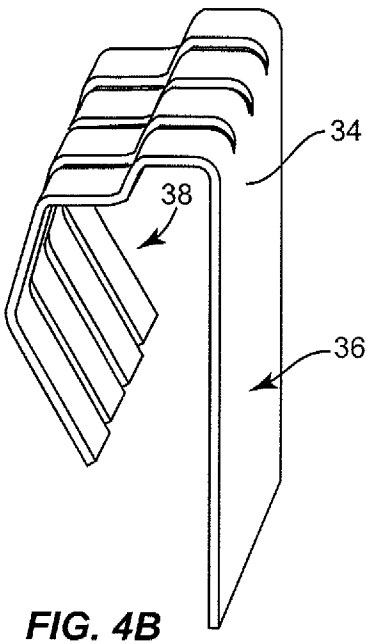
Figure 4A:
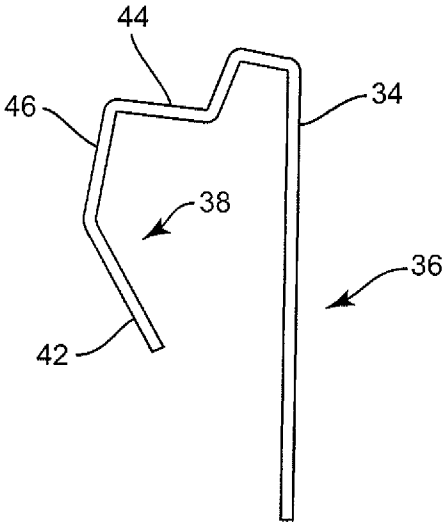

FIGS. 4A-4C illustrate the retaining member as a spring member 34 rather than a resilient member 32. This spring member 34 mounts on the upper end of the shaft 12 and may comprise, for instance, a spring clip that clips onto the shaft's sidewall. Mounted in this position, the spring member 34 engages the channel 30 when the capital 14 is moved onto the spring member 34. This engagement supports or holds the capital 14 at a fixed vertical position along the shaft 12 (e.g., at the upper end of the shaft 12).

In more detail, the spring member 34 comprises a base member 36 and one or more fingers 38 that extend from the base member 36. With the spring member 34 mounted onto the upper end of the shaft 12, the base member 36 engages the inner surface 40 of the shaft 12. The fingers 38 are biased away from this base member 36. When the capital 14 is moved onto the spring member 34, the one or more fingers 38 deflect toward the base member 36 and engage the capital's channel 30. Because the one or more fingers 38 are biased away from the base member 36, the fingers' deflection produces an outward force against the channel 30 that holds the capital 14 at a fixed vertical position along the shaft 12.

In this regard, each finger 38 has a guide end 42, an upper ridge 44, and an intermediate edge 46 connecting the guide end 42 and upper ridge 44. The guide end 42 protrudes at a downward angle from the intermediate edge 46 toward the base member 36. Disposed in this way, the guide end 42 is configured to guide the capital 14 onto the spring member 34 as the capital 14 is moved up along the shaft 12 towards the shaft's upper end (see FIG. 4C). As the capital 14 is guided onto the spring member 36 in this way, the capital 14 deflects the fingers 38 toward the base member 36. Then, when the capital 14 is finally moved onto the spring member 36, the upper ridge 44 engages an upper surface of the channel 30 and the guide end 42 engages a lower surface of the channel 30.

Regardless of the particular type of retaining member, the retaining member conveniently holds the capital 14 in a fixed vertical position along the shaft 14 without the need of cumbersome fasteners (e.g., screws or nails) that may require the combined manpower of multiple workers for proper installation. Moreover, the retaining member proves sufficient for holding a capital that advantageously has a substantially planar upper surface, especially if the capital is made of a lightweight material such as polyurethane foam.

Figure 5A:
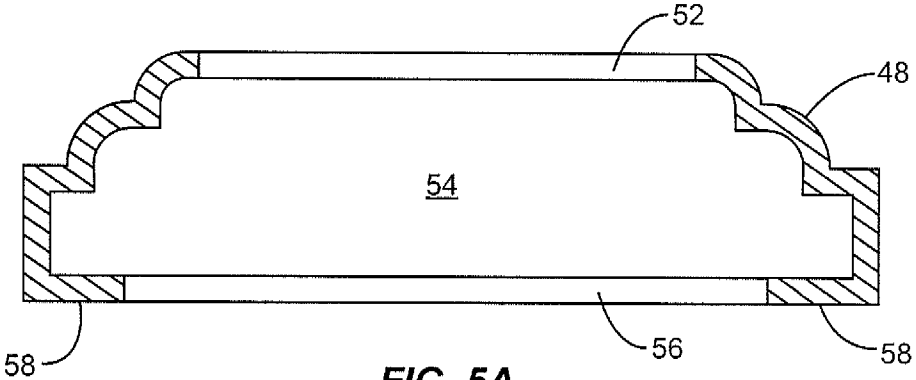
FIGS. 5A-5B illustrate a base assembly configured according to one embodiment of the present invention. Particularly.
Figure 5B:
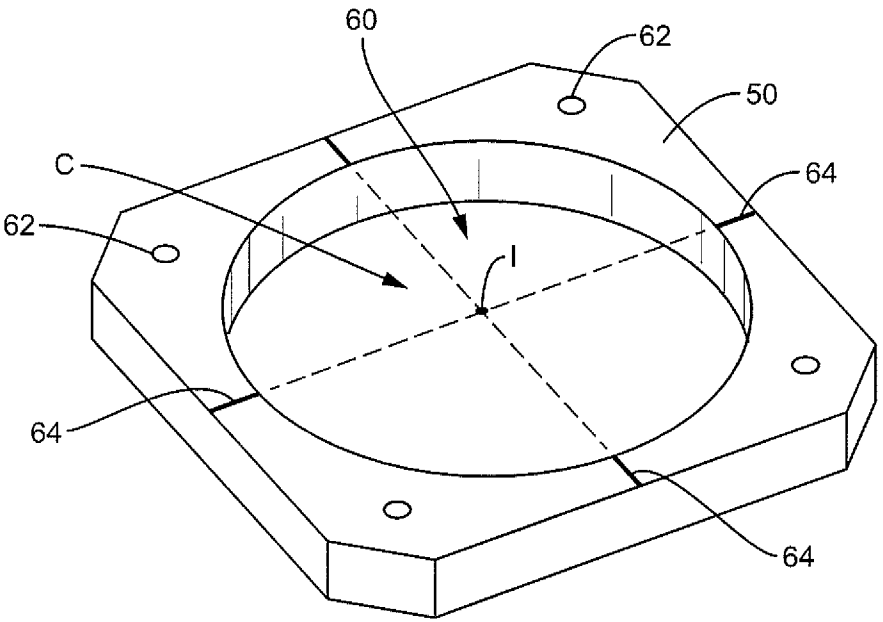

FIGS. 5A-5B now illustrate additional details of the base assembly 16. As seen in these figures, the base assembly 16 comprises a base or "plinth" 48 (FIG. 5A) and a retaining ring 50 (FIG. 5B). The plinth 48 is a decorative element disposed at the bottom end of the shaft 12 after installation. The main function of the plinth 48 is to cover the retaining ring 50 and provide aesthetics. The plinth 48 is a substantially enclosed member, but has an opening 52 in a top surface to receive a lower part of the shaft 12 into an interior cavity 54. The plinth 48 also includes an opening 56 formed in a bottom surface 58. The opening 56 is sized and shaped to receive the retaining ring 50 once the retaining ring 50 is installed.

Retaining ring 50 comprises a plate-like member having a centrally located opening 60 and a plurality of holes 62. The central opening 60 receives the lower part of the shaft 12, while the holes 62 receive corresponding mechanical fasteners such as deck screws to securely affix the retaining ring 50 to an underlying support surface. Additionally, the retaining ring 50 comprises a plurality of notches 64 formed in the upper surface of the retaining ring 50. The notches 64 are disposed adjacent the central opening 60 and are arranged so as to form the defining ends of a "cross-hair" C having an intersection I located at a center of the opening 60. As will be seen in more detail below, the notches 64, in concert with another vertical alignment mechanism, allow a worker to ensure that the center of the retaining ring 50 is vertically aligned with a center line of the shaft 12.

Figure 6:
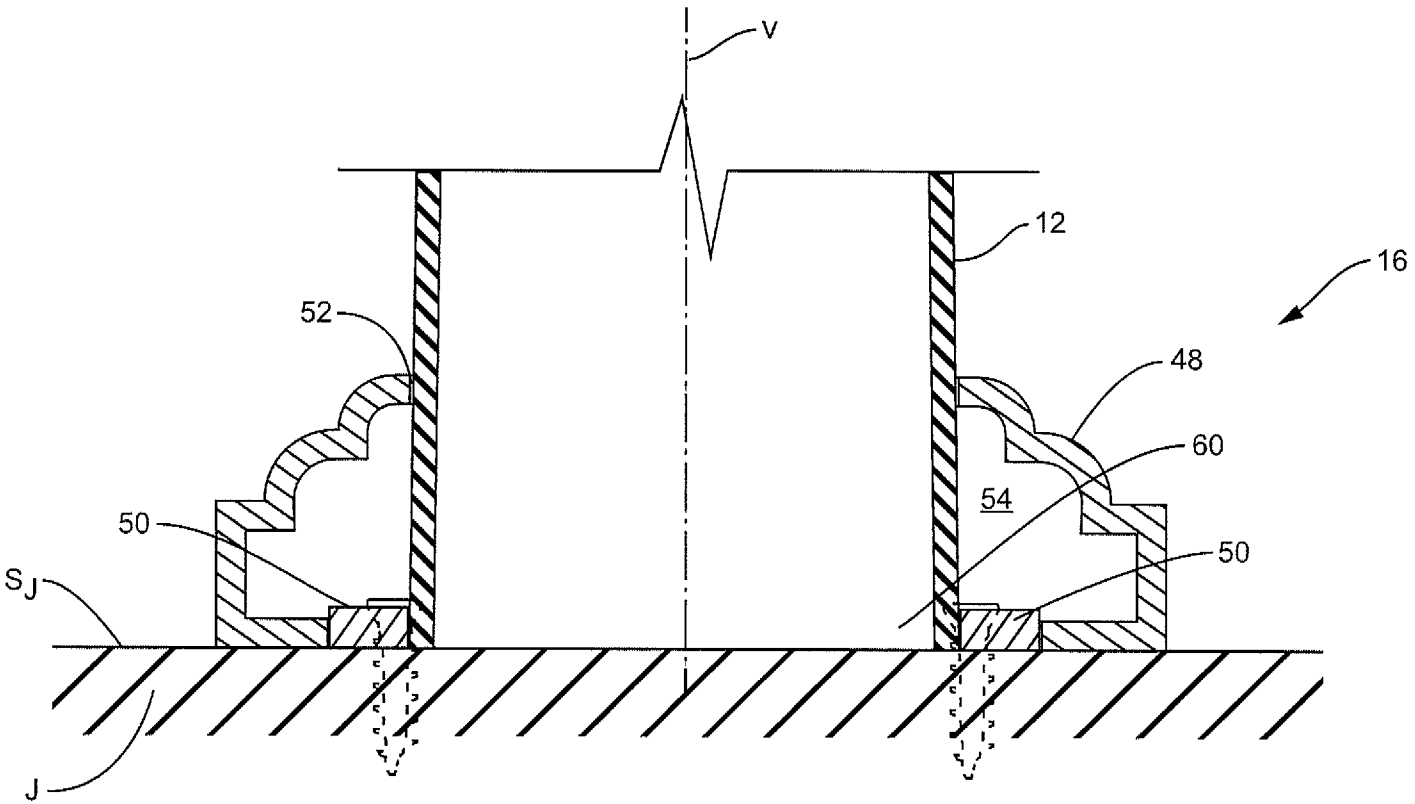
FIG. 6 is a side sectional view of a base assembly configured according to one embodiment of the present invention for surrounding a lower part of a shaft.

FIG. 6 is a sectional view illustrating how the base assembly 16 may be installed according to one embodiment of the present invention. As seen in FIG. 6, the center of the base assembly 16 is substantially aligned with the center line v of the shaft 12, and thus, is also substantially aligned with the center of capital 14 (not shown). The retaining ring 50 is screwed into the surface $S_J$ of an underlying support member, such as floor joist J. The lower part of the shaft 12 extends through opening 52 in the top surface of plinth 48 and the central opening 60 of the retaining ring 50, and is supported by the surface $S_J$. The retaining ring 50 prevents the undesirable lateral movement of the bottom of the shaft 12. The plinth 48 is placed over the retaining ring 50 such that it covers the retaining ring 50 and the mechanical fasteners securing the retaining ring 50 to the surface $S_J$.

Figure 7:
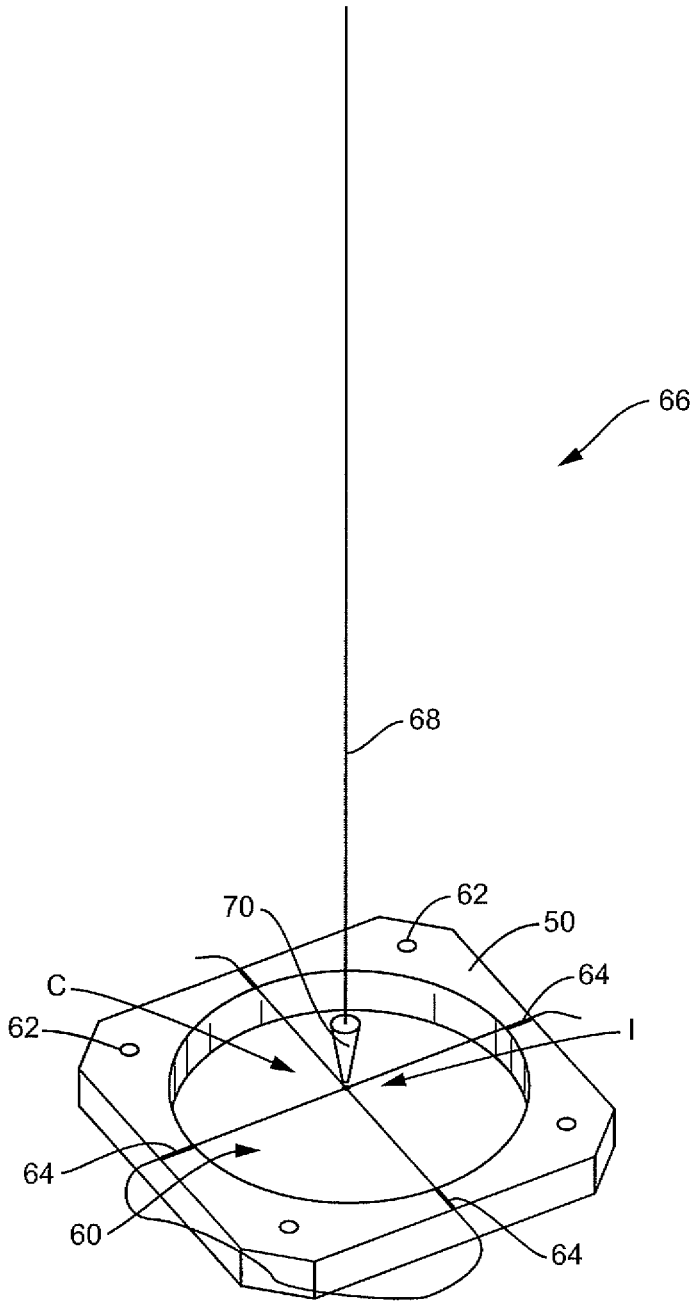
FIG. 7 is a perspective view illustrating an alignment mechanism according to one embodiment of the present invention.

FIG. 7 illustrates an alignment mechanism 66 configured to assist, in conjunction with the notches 64 formed in the upper surface of the retaining ring 50, a worker align the retaining ring 50 with the center line v of the shaft 12. The alignment mechanism 66 comprises a flexible plumb line 68, such as a string, and a mass or "bob" 70 connected to the plumb line 68. The bob 70 hangs down from the plumb line 68 along the center line v of the shaft 12 towards the center of the retaining ring 50. Using the cross-hair C as a guide, the worker can place the retaining ring 52 on the underlying support surface such that the bob 70 is suspended directly above the center of the retaining ring 50, as indicated by the intersection I. Once this occurs, the center of the retaining ring 50 is aligned with the shaft's center line v.

Notice in FIG. 7 that the notches 64 are sized and configured to receive a string therein. With the notches 64 configured in this way, the worker can arrange the string to seat within the notches 64 and to overlap at the intersection I. This overlap serves as a visual aid to more precisely indicate the intersection I to the worker.

Although not shown, a target mechanism may be used in conjunction with the notches 64 and string, or as an alternative thereto, for aligning the plumb line bob 70 with the center of the retaining ring's opening 60. In this regard, the target mechanism is configured to indicate the center of the retaining ring's opening 60. The target mechanism is flat, but is otherwise sized and/or shaped to correspond to the size and/or shape of the retaining ring 50. Sized and/or shaped in this way, the target mechanism may be readily aligned by the worker with the retaining ring 50, or even used to simply trace on the underlying support surface where the retaining ring 50 is to be positioned.

In some embodiments, for example, the target mechanism is a flat, square member with a width and length that approximately corresponds to the width and length of the retaining ring 50. Such a target mechanism may also include markings that approximately align with the retaining ring's holes 62, so that by aligning the target mechanism's markings with the retaining ring's holes 62 the worker aligns the target mechanism with the retaining ring 50. Regardless, the target mechanism includes a central marking or hole that indicates the center of the retaining ring's opening 60 to the worker.

In other embodiments, the target mechanism is a flat, circular member with a radius that approximately corresponds to the radius of the retaining ring's opening 60. By placing such a target mechanism within the retaining ring's opening 60, the worker aligns the target mechanism with the retaining ring 50. As in the former embodiments, the target mechanism includes a central marking or hole that indicates the center of the retaining ring's opening 60 to the worker.

Figure 8A:
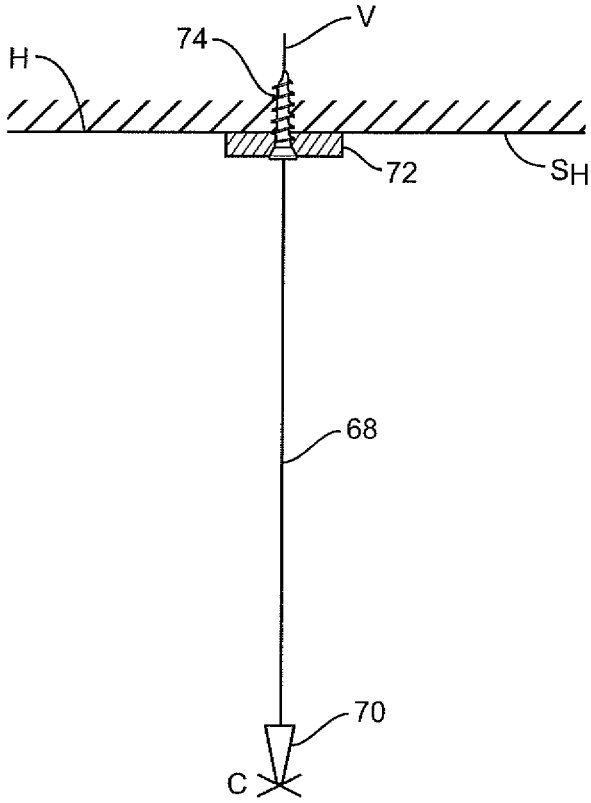
FIGS. 8A-8C illustrate installation of the column assembly using an alignment mechanism, according to one embodiment where the column assembly includes an indexing member that affixes to an overhead support structure.
Figure 8C:
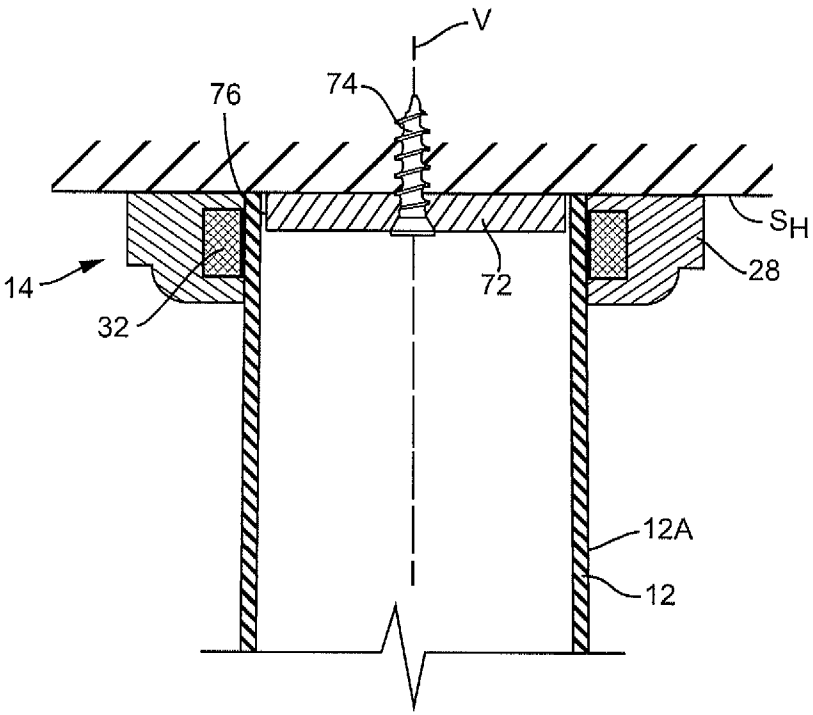
Figure 8B:
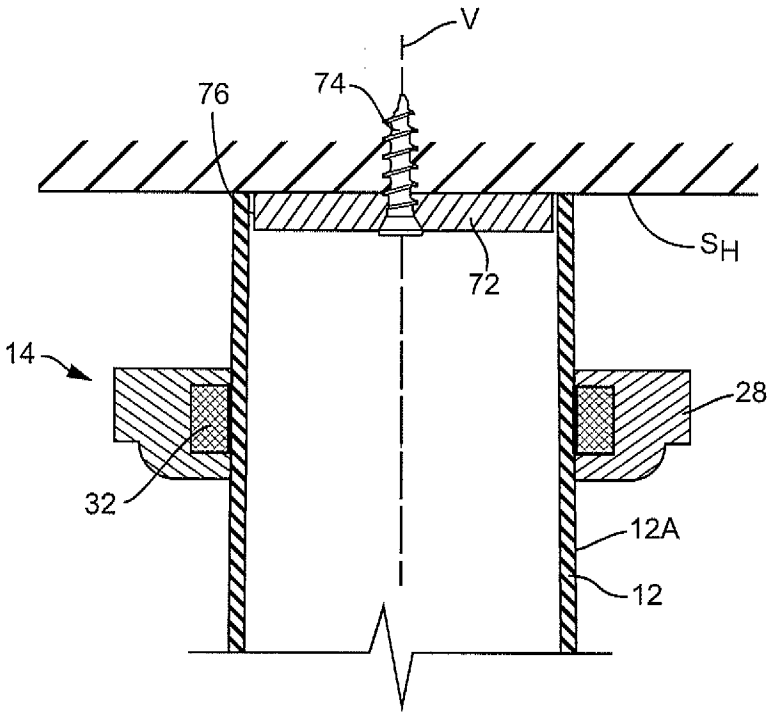

FIGS. 8A-8C and 9A-9D further illustrate use of the alignment mechanism 66 for different installation scenarios. FIGS. 8A-8C depict an installation scenario that permits use of an indexing member 72 included in the column assembly 10 for vertically aligning the shaft 12. Such installation scenario may, for instance, install the column assembly 10 to support an outdoor porch roof that can be temporarily lifted up to move the shaft into place. FIGS. 9A-9D, by contrast, depict an installation scenario that does not permit use of an indexing member 72. This latter scenario may install the column assembly 10 to support an indoor ceiling that cannot be temporarily lifted up.

According to the installation scenario shown in FIG. 8A, the worker first determines where the capital 14 will make contact with the surface $S_H$ of an overhead support, such as a porch roof H. Then, the worker affixes the indexing member 72 to the surface $S_H$ using, for example, a deck screw 74 extending through a through-hole. The indexing member 72 is positioned such that a center point of the indexing member 72 is aligned along the vertical axis v. Once attached, the top surface of the indexing member 72 contacts the surface $S_H$ of the header H.

Once the indexing member 72 is affixed to surface S, the worker attaches one end of the plumb line 62 to the center of the indexing member 72. The worker may use an adhesive for such attachment. Then, using the cross-hair C as a guide, the worker places the retaining ring 52 on the underlying support surface such that the bob 70 is suspended directly above the center of the retaining ring 50, as indicated by the intersection I. Once this occurs, the center of the retaining ring 50 is also aligned with the vertical axis v. The worker then uses mechanical screws to securely affix the retaining ring 52 to the underlying support surface.

With both the indexing member 72 and the retaining ring 50 secured in alignment along the vertical axis v, the worker removes the plumb line 62 and bob 70. The worker then places the shaft 12 into position, as shown in FIG. 8B. This may require that the worker lift up the overhead support surface for the shaft 12 to clear the indexing member 72 and retaining ring 50. Regardless, the indexing member 72 has a size and shape that approximately corresponds to the size and shape of an alignment opening 76 formed at the upper end of the shaft 12. Thus, when the shaft 12 is moved into position around the indexing member 72, the indexing member 72 seats within the shaft's alignment opening 76. Because the indexing member 72 is aligned along the vertical axis v and seats within the alignment opening 76, the indexing member 72 vertically aligns the shaft 12 along the vertical axis v.

Note of course that the worker, before placing the shaft 12 into position, slips the capital 14 and plinth 48 onto respective ends of the shaft 12. This way, once the shaft 12 is actually in position around the indexing member 72 and retaining ring 50, the capital 14 and plinth 48 may be moved up and down, respectively, toward the shaft ends. FIGS. 8B-8C illustrate this process for the capital 14 in particular, where as an example the retaining member for the capital 14 is resilient member 32.

As shown in FIG. 8B, the resilient member 32 holds the capital 14 at a fixed vertical position that is offset from the top of the shaft 12. With the capital 14 fixed in this position, the worker may move the shaft 12 into position around the indexing member 72 with greater ease than if the capital 14 had been fixed all the way at the top of the shaft 12. Once the shaft 12 is in position, though, the worker then re-positions the capital 14 to be fixed at the top of the shaft 12, completing the installation as shown in FIG. 8C.

Because the capital 14 and plinth 48 are positioned around the shaft 12, the shaft 12 inherently aligns them with the vertical axis v. Thus, the indexing member 72 vertically aligns the shaft 12 and the shaft 12 vertically aligns the capital 14 and plinth 48. The process of installing the column assembly 10 thus requires fewer workers than do the installation processes of conventional columns. Particularly, ensuring vertical alignment using a column assembly 10 of the present invention requires the workers to ensure the vertical alignment of a small, manageable indexing member 72. Once that is aligned, the structural aspects of the column assembly 10 ensure that the shaft 12 and capital 14 will also align vertically. Conventional processes, in contrast, require workers to align the shaft and/or the capital as a complete unit. These, however, are often harder to handle and to vertically align, thereby requiring more time, effort, and personnel to install.

Figure 9A:
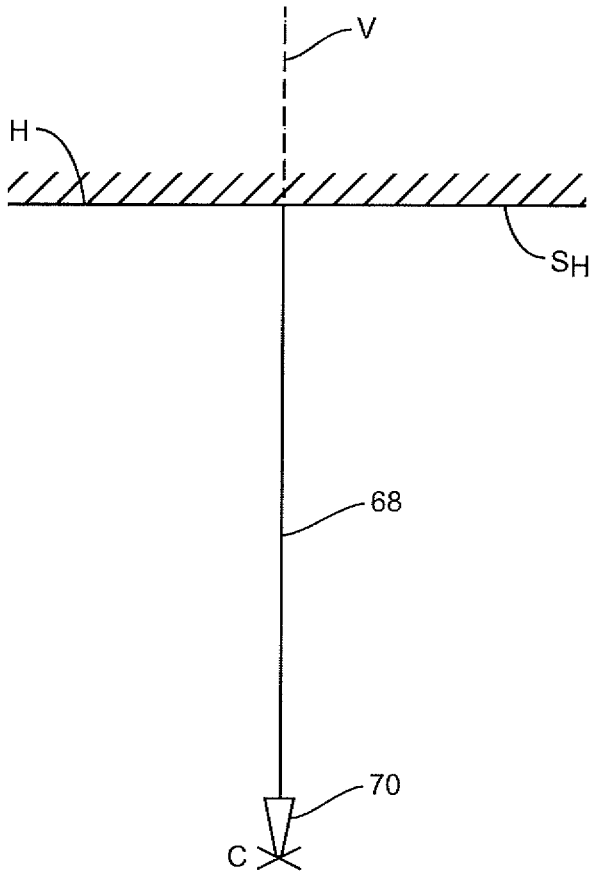
FIGS. 9A-9D illustrate installation of the column assembly using an alignment mechanism, according to one embodiment where the shaft of the column assembly affixes to an overhead support structure.

By contrast, the installation scenario shown in FIGS. 9A-9D may not permit use of such an indexing member 72. In this case, as shown in FIG. 9A, the worker first determines and marks the point on the overhead support surface (e.g., a floor joist) where the center of the shaft 12 is to be positioned. In at least some embodiments, the worker then uses a target mechanism centered over that point to outline on the overhead support surface where the outer perimeter of the shaft 12 is to be positioned on the overhead support surface.

For example, in the case that the shaft 12 is cylindrical with a circular cross section, the worker uses the target mechanism to outline a circle on the overhead support surface where the outer circumference of the shaft 12 is to be positioned. In one embodiment, such a target mechanism comprises at least two holes, or at least two markings that indicate where the worker is to punch holes. The two holes or markings are separated by a distance that corresponds to the radius of the shaft 12. The worker aligns a first hole with the center point marked on the overhead surface, and temporarily secures the target mechanism to the overhead support surface with a mechanical fastener through that first hole. The worker then places a pencil or other marking utensil through a second hole and onto the overhead support surface, and outlines a circle on the overhead support surface by rotating the target mechanism around the mechanical fastener.

In the case that the shaft 12 has a square or rectangular cross section, the worker uses the target mechanism to outline a corresponding square or rectangle on the overhead support surface where the outer perimeter of the shaft 12 is to be positioned. In one embodiment, therefore, the target mechanism has the same square or rectangular shape as the shaft's cross section. The worker aligns the center of the target mechanism with the center point marked on the overhead surface and then traces around the target mechanism to outline a square or rectangle on the overhead support surface.

Having marked at least the center point of the shaft 12 on the overhead support surface, the worker attaches one end of the plumb line 62 directly to the overhead support surface at this center point. The worker may use an adhesive for such attachment. In some embodiments, for example, an adhesive member is attached to the overhead support surface and the plumb line 62 is attached to and hangs from that adhesive member. In this case, the worker may use the target mechanism above to also outline on the overhead support surface where the outer perimeter of the adhesive member is to be positioned on the overhead support surface.

The target mechanism may include, for instance, a third hold that is separated from the centrally aligned hole by a distance that corresponds to a radius of the adhesive member. Thus, the worker may use the second hole to outline a circle where the outer circumference of the shaft 12 is to be positioned, and use the third hole to outline a circle where the outer circumference of the adhesive member is to be positioned. Of course, where the circumference of the shaft 12 is the same as the circumference of the adhesive member, the second hole may be used for outlining the position of both the shaft 12 and the adhesive member. Also note that the target mechanism used to outline the position of the shaft 12 and/or adhesive member may be the same or a different target mechanism as that discussed above for visually indicating the center of the retaining ring's opening 60.

Figure 9C:
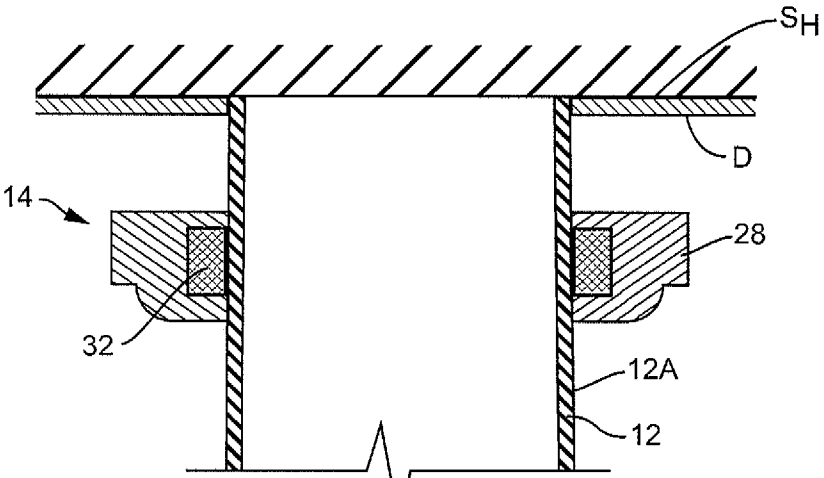
Figure 9B:
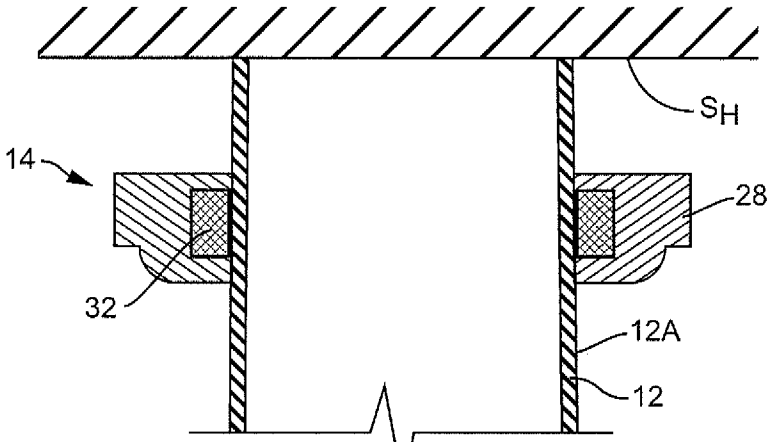

Regardless, with the plumb line 62 attached to the overhead support surface, the worker uses the bob 64 and cross-hair C in a similar manner as described above, to install the retaining ring 50 in alignment with the vertical axis v. With the retaining ring 50 secured in alignment along the vertical axis v, the worker removes the plumb line 62 and bob 70. The worker then places the shaft 12 into position, as shown in FIG. 9B, e.g., by aligning the outer perimeter of the shaft 12 with the circular outline previously marked on the overhead support surface. The worker may attach the shaft 12 directly to the overhead support surface, in alignment with the vertical axis v, using an adhesive.

Figure 9D:
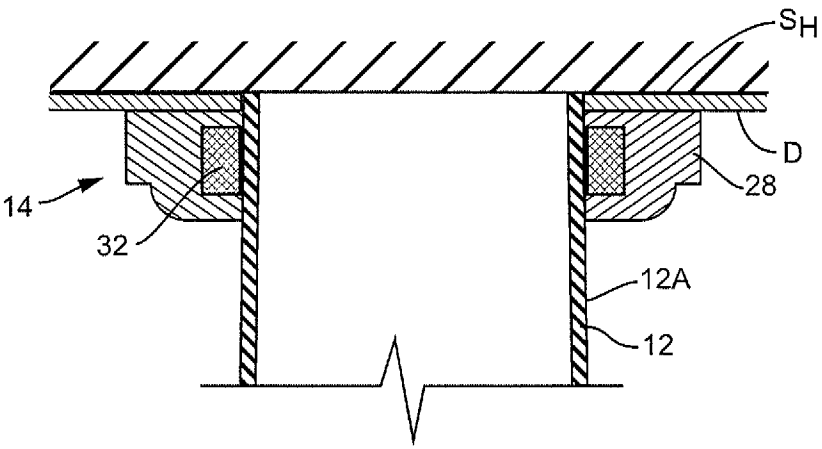

Often, the overhead support surface (e.g., a floor joist) is subsequently covered with another material D (e.g., drywall) to form a ceiling. In the meantime, though, the worker intentionally positions the capital 14, via the resilient member 38, to be vertically offset from the top of the shaft 12. This way, installation of the ceiling material D directly against the shaft 12 may proceed without obstruction by the capital 14, as shown in FIG. 9C. Then, when the ceiling material D has been installed, the capital 14 may be re-positioned to be fixed at the top of the shaft 12, completing the installation as shown in FIG. 9D.

Figure 10B:
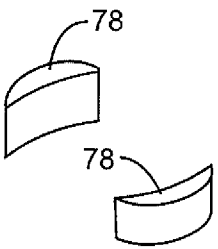
FIGS. 10A-10B illustrate a capital that, according to one embodiment, comprises two separate sections.
Figure 10A:
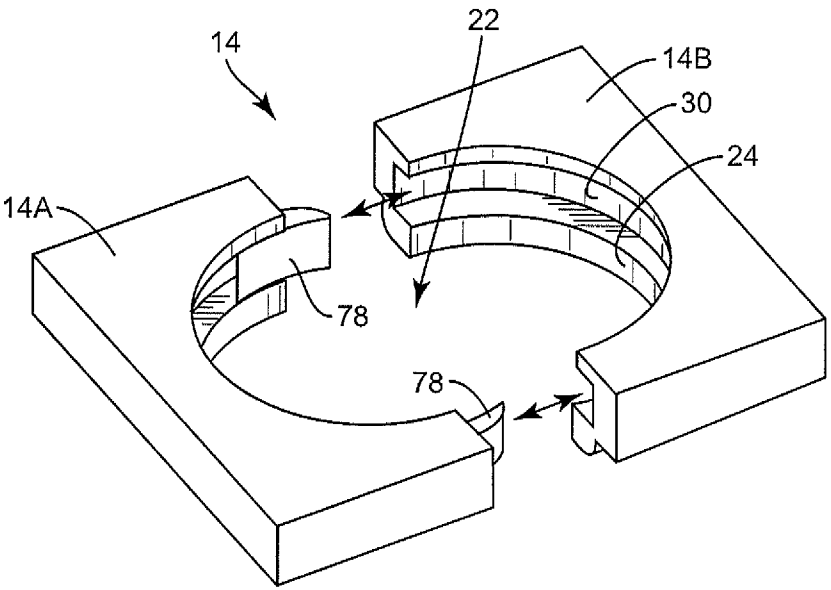

While the above installation scenarios made use of a capital 14 formed as a single structure, other installation scenarios may use a capital 14 that comprises two separate sections. FIGS. 10A-10B illustrate such a capital 14. As shown in FIG. 10A, the capital 14 comprises two separate sections 14A and 14B, each with a portion of the channel 30 formed therein. Aligning of the sections 14A, 14B together forms opening 30 and forms the complete channel 30.

One or more locating features assist in such alignment. As shown, the column assembly 10 includes two locating features. These locating features comprise projections 78 that extend from section 14A. The projections 78 seat within the channel 30 formed in that section 14A and are configured to fit into the channel 30 formed in the other section 14B when the sections 14A, 14B are aligned.

The present invention may, of course, be carried out in other specific ways than those herein set forth without departing from the scope and essential characteristics of the invention. For example, the columns described previously are not limited for use in residential construction, but rather, may be used for commercial applications as well. Further, the shaft 10 need not be cylindrical or smooth. In many cases, the shaft 10 may be square and/or fluted. Therefore, the present embodiments are to be considered in all respects as illustrative and not restrictive, and all changes coming within the meaning and equivalency range of the appended claims are intended to be embraced therein.

What is claimed is:

1. A column assembly comprising:

a shaft;

a capital having a lower surface and a substantially planar upper surface;

an opening formed in said capital and sized to receive the shaft therethrough, said opening extending from the lower surface of the capital and to the upper surface;

a channel formed in a surrounding wall of the opening;

a retaining member configured to hold the capital at a fixed vertical position along the shaft by engaging the channel and the shaft, wherein the retaining member is a resilient member that comprises foam and that is configured to seat within the channel.

2. The column assembly of claim 1, wherein the length of the channel extends at least partially around a perimeter of the opening.

3. The column assembly of claim 1, wherein the resilient member is configured to frictionally engage an outer surface of the shaft.

4. The column assembly of claim 1, wherein the resilient member is configured to engage an outer surface of the shaft with a frictional resistance that is sufficient to hold the capital at any given vertical position along the shaft but that can be overcome to re-position the capital along the shaft as desired.

* * * * *